US006145605A

United States Patent [19]

Karlsson

[11] Patent Number: 6,145,605

[45] Date of Patent: Nov. 14, 2000

[54] ROTARY DRILL BIT AND ROLLER CUTTER FOR ROCK DRILLING

[75] Inventor: Lennart Karlsson, Sandviken, Sweden

[73] Assignee: Sandvik AB, Sandviken, Sweden

[21] Appl. No.: 09/192,585

[22] Filed: Nov. 17, 1998

[30] Foreign Application Priority Data

Nov. 19, 1997 [SE] Sweden ..... 9704233

[51] Int. Cl.[7] ..... E21B 10/16

[52] U.S. Cl. ..... 175/331; 430/431

[58] Field of Search ..... 175/331, 376, 175/378, 397, 401, 420.1, 426, 430, 431

[56] References Cited

U.S. PATENT DOCUMENTS

| | | | |
|---|---|---|---|
| 4,343,371 | 8/1982 | Baker, III et al. | 175/376 X |
| 5,172,777 | 12/1992 | Siracki et al. | 175/430 X |
| 5,323,865 | 6/1994 | Isbell et al. | 175/378 |
| 5,592,995 | 1/1997 | Scott et al. | 175/430 X |
| 5,881,828 | 3/1999 | Fischer et al. | 175/430 X |

*Primary Examiner*—David Bagnell
*Assistant Examiner*—Kamal Dawelbeit
*Attorney, Agent, or Firm*—Burns, Doane, Swecker & Mathis, L.L.P.

[57] ABSTRACT

A rotary rock drill bit includes a bit body and three conical roller cutters rotatably mounted thereon. Each roller cutter has at least first, second, and third circumferential rows of buttons spaced apart in the direction of rotation of the roller cutter. The three rows of buttons are arranged successively from a rear end toward a front end of the roller cutter. The buttons of each of the first and second rows have lengths of attack which are longer in a direction of rotation of the roller cutter than in a direction perpendicular thereto. Those longer lengths of attack are also longer than a length of attack of the buttons of the third row in the rotational direction.

10 Claims, 3 Drawing Sheets

FIG. 1B
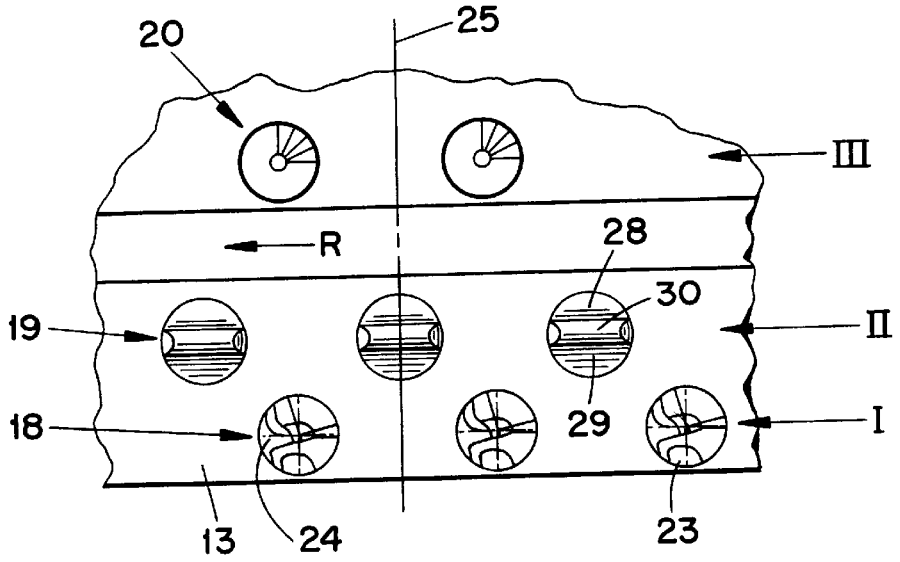
FIG. 5A
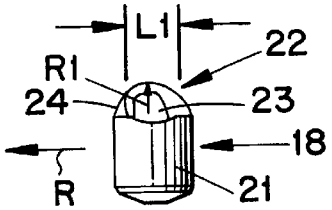
FIG. 6A
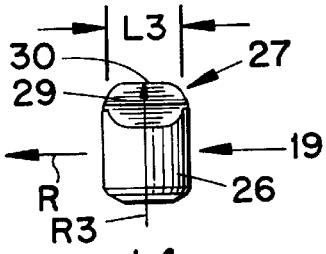
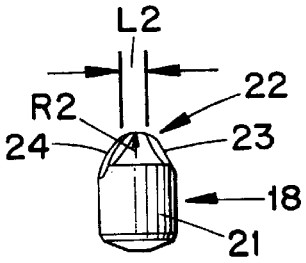
FIG. 5B
FIG. 7A
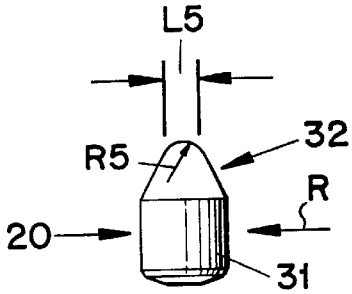
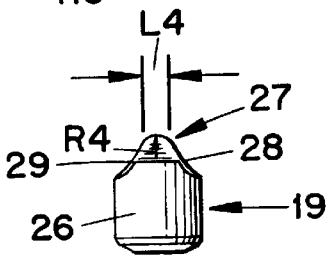
FIG. 6B
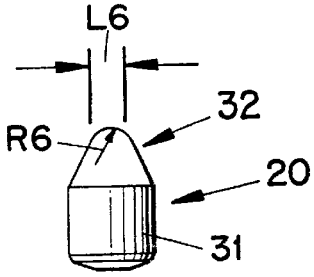
FIG. 7B FIG. 3
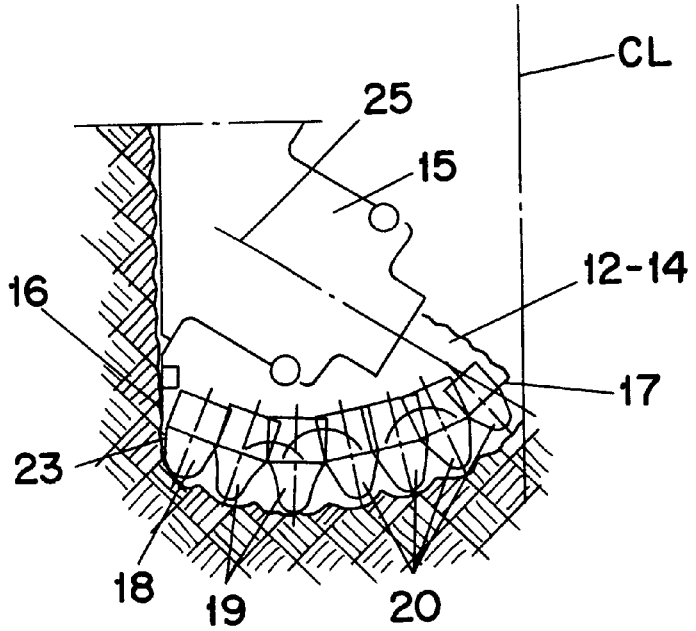
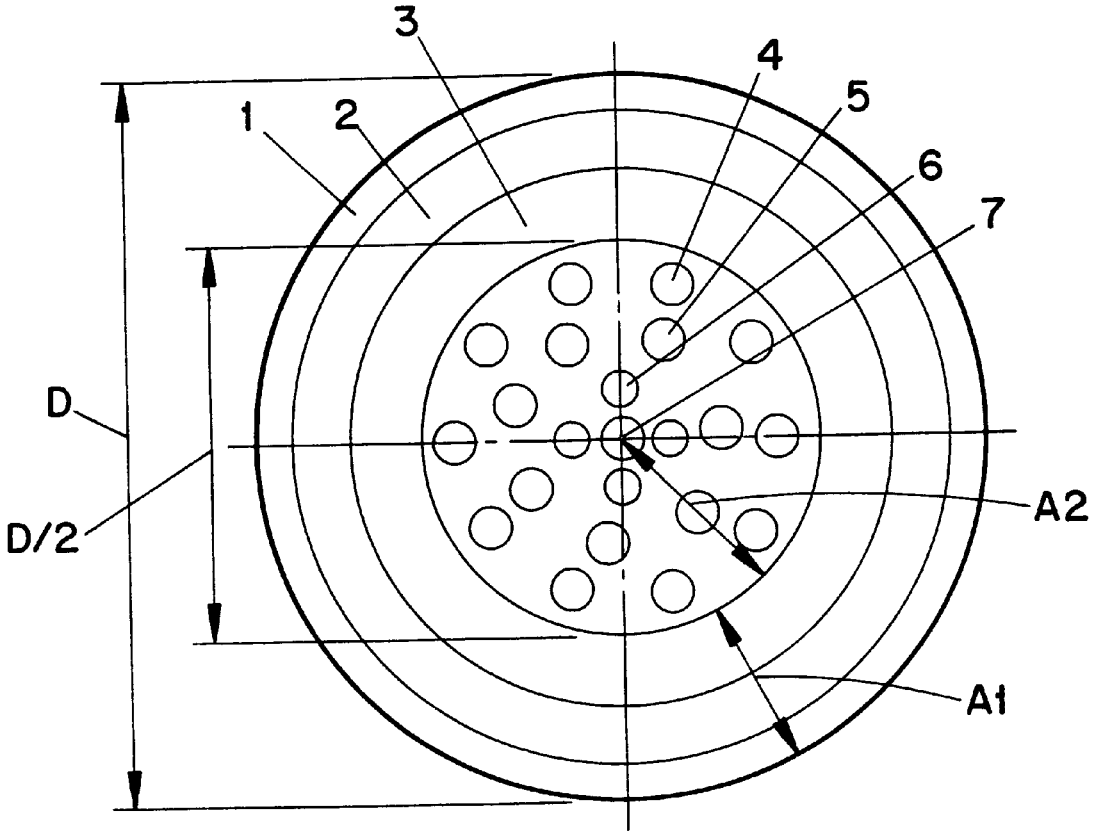
FIG. 4

ROTARY DRILL BIT AND ROLLER CUTTER FOR ROCK DRILLING

BACKGROUND OF THE INVENTION

The present invention relates to a rotary drill bit and a roller cutter for rock drilling.

PRIOR ART

A conventional rock drill bit includes a bit body and three roller cutters. Each roller cutter is rotatably mounted on a journal protruding from the bit body. Buttons formed of cemented carbide are arranged in rows in each roller cutter. Each button has a curved working end which is semi-spherical. When the curved working end comes into engagement with the rock in the hole which is to be drilled, a crater is formed by cracking the rock around the button. However, the button during the next revolution tends to be positioned in the crater such that the trailing button cracks relatively little rock, whereby so called "tracking" appears and the hole bottom becomes very uneven.

To correct this problem, Isbell et al. U.S. Pat. No. 5,323,865 suggests a rock drill bit which comprises three rotatable rolls, each comprising rows of buttons for crushing the rock. The working end of each button has a chisel shape. The direction of the chisel in the radially outermost row of a roller cutter extends transverse to the axis of rotation of the roller cutter while in the remaining rows the direction of the chisel is parallel with said axis of rotation. However, the roller cutter does not have a satisfactory service life. The chisel buttons in the radially outermost row, which are subjected to great forces from the well bore wall and the hole bottom, are quickly damaged. Furthermore, the known drill bit requires a high feed force.

OBJECTS AND SUMMARY OF THE INVENTION

One object of the present invention is to provide an improved rock drill bit for rotary crushing drilling which maintains the same advantages as known drill bits.

Another object of the present invention is to provide a rock drill bit for rotary crushing drilling which provides a favorable crushing pattern in the drilled hole.

Still another object of the present invention is to provide a rock drill bit for rotary crushing drilling having a long service life.

Still another object of the present invent-Ion is to provide a rock drill bit and a roller cutter for rotary crushing drilling which requires a relatively low feed force.

These and other objects are achieved by means of a rotary drill bit comprising a bit body and three roller cutters. Each roller cutter is rotatably mounted on a journal protruding from the bit body. Each roller cutter includes a roller body having a generally conical shape with a rear end facing generally towards the periphery of the drill bit and a front end facing generally towards a rotational center of the drill bit. A number of buttons are provided in each roller body to form at least first, second, and third circumferential rows of buttons. The first, second, and third rows of buttons are arranged successively from the rear end toward the front end of the roller body. Each button has a working end which projects from the bit body and which during rotation of the roller cutter comes into engagement with the rock. The buttons of each of the first and second rows have a length of attack which is longer in a direction of rotation of the roller cutter than in a direction perpendicular thereto. The buttons of the third row have a length of attack in the rotational direction which is shorter than the length of attack of the buttons of the first and second rows in the rotational direction.

The present invention also relates to the rotary cutter per se.

BRIEF DESCRIPTION OF THE DRAWING

The objects and advantages of the invention will become apparent from the following detailed description of a preferred embodiment thereof in connection with the accompanying drawing in which like numerals designate like elements and in which:

FIG. 1B is an enlarged fragmentary view of one of the roller cutters depicted in FIG. 1A;

FIG. 3 is a schematic view depicting the engagement of buttons of the roller cutters with rock being cut;

FIG. 4 is a schematic view of the bottom of a drill hole after having been drilled with a rotary drill bit according to the present invention;

FIGS. 5A and 5B are respective side elevational views of a first type of button used in the present invention, the side views taken 90° apart from one another;

FIGS. 6A and 6B are views similar to FIGS. 5A and 5B, respectively, of a second type of button used in the present invention;

FIGS. 7A and 7B are views similar to FIGS. 5A and 5B, respectively of a third type of button used in the present invention.

DETAILED DESCRIPTION OF A PREFERRED EMBODIMENT OF THE INVENTION

Figure 1A:
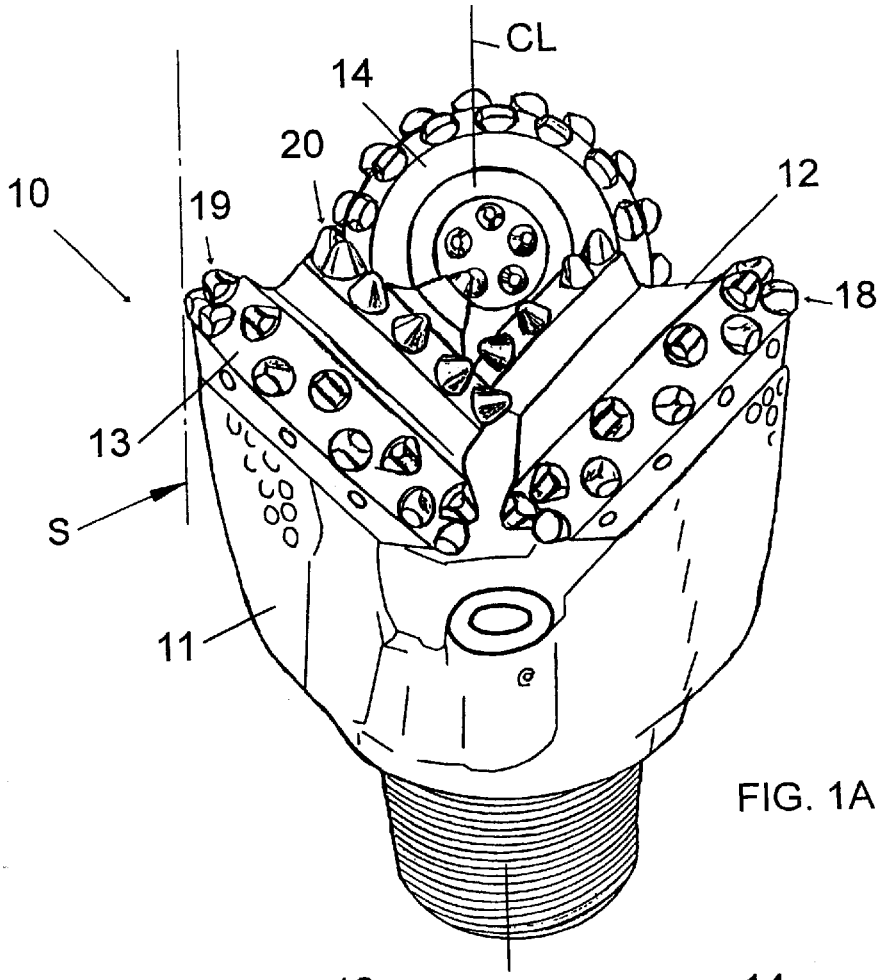
FIG. 1A is a front perspective view of a rotary drill bit according to the present invention.
Figure 2:
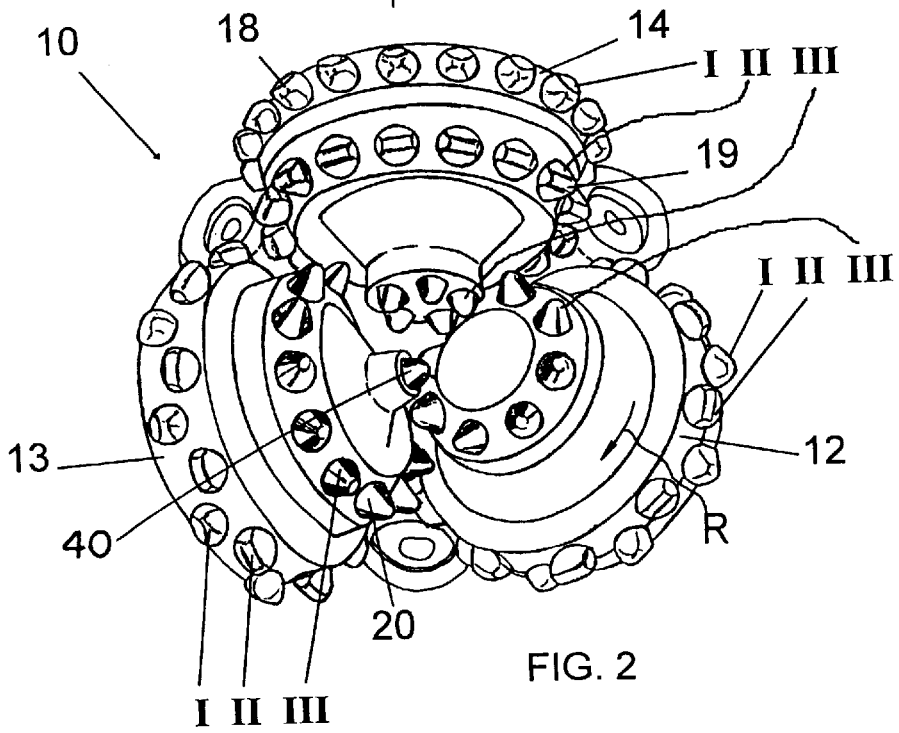
FIG. 2 is a front end view of the roller cutter depicted in FIG. 1.

FIGS. 1A and 2 show a rotary drill bit 10 for rock drilling according to the present invention and buttons therefor. The rotary drill bit 10 comprises a bit body 11 and three roller cutters 12, 13, 14. Each roller cutter is rotatable mounted on a journal 15 which protrudes from the bit body 11. Each roller cutter includes a roller body having a substantially conical basic shape with a rear end or base 16 facing substantially in a direction towards the periphery of the drill bit and a front end or top 17 essentially facing towards the center of the drill bit (see FIG. 3). A number of buttons 18, 19, 20 are respectively provided in each cutter body to form three or more circumferential rows I–III. Together these rows create a number of circular cutting patterns 1–7 in the rock (FIG. 4), since the positions of all rows except for the first row I are displaced, in the axial direction CL of the roller cutters from one roller cutter to another.

The working end of each button projects from the surrounding material in the steel roller body and comes into engagement with the rock during rotation of the roller cutter, thereby forming a surface of attack with the rock. The surface of attack defines a length of attack against the rock in the rotational direction R of the roller cutter (the lengths of attack designated as L1, L3, and L5 for respective buttons in FIGS. 5A, 6A, 7A, respectively), as well as a length of attack perpendicularly to the rotational direction (designated as L2, L4, L6 for respective buttons in FIGS. 5B, 6B, 7B, respectively).

The first row of buttons I is located next to the base 16 and comprises buttons 18 (FIG. 1B). Each button 18 in the first row has a substantially cylindrical mounting portion 21 and a working end 22 (see FIG. 5A, 5B). The working end 22 comprises a first portion having a relatively flat surface 23, which extends from said mounting portion in a direction towards a forward end of said button. The working end 22 also includes a second portion 24 which has a convexly curved basic shape FIGS. 5A, 5B. Each button 18 is secured in a hole in the roller body such that its radially extreme surface 23 essentially coincides with the jacket surface S of the roller cutter drill bit (see FIG. 1A).

The top of the working end 22 of the button 18 has two different radii of curvature R1, R2 (shown in FIGS. 5A, 5B respectively) depending on where the cross section through the longitudinal axis of the button is taken. Consequently, in the button 18, the radius R1 of the curvature extending in the rotational direction R of the roller cutter (FIG. 5A) is greater than the radius R2 of the curvature extending perpendicularly to the rotational direction R (FIG. 5B). The relatively flat surface 23 connects circumferentially to at least one crest-like cutting edge 24 extending generally perpendicularly to the axis 25 of rotation of the roller cutter. The buttons 18 are configured and arranged such that the steel roller body does not become unnecessary worn, and therefore the diameter of the drilled hole remains essentially constant during the entire drilling operation.

The second row II is provided in front of the first row I and comprises buttons 19 (FIG. 1B). Each button 19 in the second row II has a substantially cylindrical mounting portion 26 and a working end 27 (see FIGS. 6A, 6B). The working end 27 comprises two essentially concave surfaces 28, 29, which connect to a chisel 30 arranged perpendicularly to the axis 25 of rotation of the roller cutter. The top of the working end 27 has two different radii of curvature R3, R4 depending on where the cross section through the longitudinal axis of the button is taken. Consequently, in the second row II, the radius R3 of the curvature extending in the rotational direction R of the roller cutter (FIG. 6A) is greater than the radius R4 of the curvature extending perpendicularly to the rotational direction R (FIG. 6B).

The third row III is provided in front of the first and second rows in a direction towards the front end 17, and the third row comprises buttons 20 (FIG. 1B). Each button 20 in the third row has a substantially cylindrical mounting portion 31 and a working end 32. The working end 32 is convexly shaped, i.e., it has a substantially conical, semispherical or ballistic basic form (the conical shape is shown in FIGS. 7A–7B), wherein the radii of curvature R5 and R6 of the working end of the button are identical regardless of which cross section is taken through the longitudinal axis of the button, i.e., the working end is symmetric about a center axis of the button 20.

When comparing the different the radii of the buttons 18–20 the following relationship applies:

R3>R1>R5 and R2>R4>R6.

In the shown preferred embodiment the rotary drill bit 10 comprises three roller cutters 12, 13, 14 each with at least three rows of buttons, whereof one roller cutter 13 also includes an axial button 40 which substantially machines the rock around the axis CL of rotation of the drill bit. Additional button rows could be provided if larger drill bits shall be used, and then the additional rows preferably are provided with buttons identical with the buttons 20 in the row III.

It will be appreciated that since R1 is greater than R2, each of the buttons 18 of the first row I has a length of attack L1 in the rotational direction R of the roller cutter which is greater than the length of attach L2 in a direction perpendicular thereto. The same is true for the button 19 of the second row II, i.e. L3>L4. In the buttons 20 of the third row III the lengths of attack are equal, i.e. L5=L6. Also each of the lengths of attack L5 and L6 is shorter than the lengths of attack L1 and L3.

A rotary drill bit according to the present invention obtains a favorable crushing pattern in the drilled hole by avoiding tracking to a great extent. This gives good penetration speed to the drill bit which is important for drilling economy. In FIG. 4 there is schematically shown a crushing pattern in the rock after drilling with a rotary drill bit according to the present invention. It is apparent from the figure that patterns 1–3 cut by the rows I and II of the three roller cutters 12, 13, 14 constitute circumferential grooves, while pattern 4 and higher cut by the rows III and higher form craters. From primarily FIG. 2 it is apparent that each roller cutter has at least three rows of buttons. The row II in the roller cutter 14 is provided closer to the rotational axis CL of the drill bit as compared to the rows II in each of the roller cutters 12 and 13. Therefor, there are produced three grooves 1, 2, 3 in the hole bottom even though there are only two of the rows I and II on each roller cutter. The reason that the buttons in row III and higher do not have a length of attack which is greater in the rotational direction R than perpendicularly thereto is that a maximum possible drilling speed is desired. That is, buttons with greater radii of curvature in the direction of rotation (i.e., perpendicularly to the axis of rotation of the roller cutter) bring about an increase of the feed force and thus an increase in energy consumption during drilling.

It has proven advantageous to arrange the buttons such that the buttons 18, 19 which cut an area A1 of the hole extending from an outer periphery thereof to at least one half of the diameter D/2 (see FIG. 4) have a larger attack length in the rotational direction R than in a direction perpendicular thereto. The buttons 20 which cut the remaining area A2 are more aggressive, i.e., they have semispherical or conical working ends, for diminishing torque damage to those buttons.

The rotary drill bit 10 comprises three geometrical different button shapes 18–20 and therefore the properties of the drill bit can be controlled in an entirely new manner as regards to wear resistance, crushing pattern and power requirements. In addition to the excellent life-span a much smaller hole deviation (i.e., deviation from the intended drilling direction) is obtained because of the good resistance to diametrical wear due to the wear resistant buttons in row I. Tests have shown that it is advantageous if the buttons, especially the buttons in row I work with the chisel aligned in the rotational direction of the roller cutter, thereby obtaining efficient cracking of the rock, reduced tracking, less wear and fewer button damages.

The invention is in no manner limited to the above described embodiment. For example the number of rows of buttons can vary depending on the size of the roller cutter bit. Also in other respects the invention can be varied within the scope of the appended claims.

What is claimed is:

1. Rotary drill bit for the rotary crushing drilling of rock, said bit comprising a bit body and three roller cutters, each roller cutter being rotatably mounted on a journal protruding from the bit body, each roller cutter including a roller body having a generally conical shape with a rear end facing generally towards the periphery of the drill bit and a front end facing generally towards a rotational center of the drill bit, wherein a number of rock-crushing buttons are provided in each roller body to form at least first, second and third circumferential rows of buttons, the first, second and third rows of buttons being arranged successively from the rear end toward the front end of the roller cutter, each button having a working end which projects from the roller body and which during rotation of the roller cutter comes into engagement with the rock, wherein each button of the first and second rows having a length of attack which is longer in a direction of rotation of the roller cutter than in a direction perpendicular thereto, the buttons of the third row having a length of attack in the rotational direction which is shorter than the lengths of attack of the buttons of the first and second rows in the rotational direction.

2. The rotary drill bit according to claim 1 wherein the working ends of the buttons in the first, second and third rows has a curvature extending in the direction of rotation and defined by first, second, and third radii of curvature, respectively, the radius of curvature for each of the buttons in the first and second rows being larger than the radius of curvature for each of the buttons in the third row.

3. The rotary drill bit according to claim 2 wherein each button of the first and second rows has an additional curvature extending generally perpendicularly to the direction of rotation, the additional curvature defined by an additional radius of curvature, the additional radius of curvature of the buttons of the first row being greater than the additional radius of curvature of the buttons of the second row.

4. The rotary drill bit according to claim 1 wherein the buttons of the first, second, and third rows, respectively, are of different geometrically different shapes.

5. The rotary drill bit according to claim 1 wherein each button of the first row includes a substantially cylindrical mounting portion mounted in a hole of the roller cutter, the working end of each button of the first row comprising a first portion having a relatively flat button surface which extends from said mounting portion in direction towards the working end of said button, said working end also having a second portion of convexly curved basic shape, a radially outmost button surface of the button substantially coinciding with a jacket surface of the roller cutter.

6. The rotary drill bit according to claim 5, wherein the convexly curved shape of the second portion of the working end comprises a ballistical basic shape, and the relatively flat button surface in a circumferential direction connects to at least one crest-like cutting edge of the button extending perpendicularly to the axis of rotation of the roller cutter.

7. The rotary drill bit according to claim 1, wherein each button of the second row comprises a substantially cylindrical mounting portion, the working end comprising two essentially concave surfaces which connect to a chisel extending perpendicularly to the axis of rotation of the roller cutter.

8. The rotary drill bit according to claim 1 wherein each button of the third row comprises a substantially cylindrical mounting portion, the working end having a substantially conical shape.

9. The rotary drill bit according to claim 1 wherein each button of the third row comprises a substantially cylindrical mounting portion, the working end having a convex shape symmetrical about a center axis of the button.

10. A roller cutter for use in a rotary rock drill bit, the roller cutter including a roller body defining an axis of rotation and having a generally conical shape with a large rear end and a smaller front end, a number of rock-crushing buttons mounted in the roller body to form at least first, second, and third circumferential rows of buttons, the first, second, and third rows of buttons being arranged successively from the rear end toward the front end of the roller cutter, each button having a working end projecting from the roller body for engaging rock during rotation of the cutter body, wherein the button of each of the first and second rows having a length of attack which is longer in a direction of rotation of the roller cutter than in a direction perpendicular thereto, the buttons of the third row having a length of attack in the rotational direction which is shorter than the lengths of attack of the buttons of the first and second rows in the rotational direction.

* * * * *